US007921523B2

(12) United States Patent
Chou

(10) Patent No.: US 7,921,523 B2
(45) **Date of Patent: *Apr. 12, 2011**

(54) STRUCTURE OF BUCKLE SET

(75) Inventor: Shu-Fang Chou, Hsin Chuang (TW)

(73) Assignee: First Rank Co., Ltd., Taipei Hsien (TW)

( * ) Notice: Subject to any disclaimer, the term of this patent is extended or adjusted under 35 U.S.C. 154(b) by 823 days.

This patent is subject to a terminal disclaimer.

(21) Appl. No.: 11/751,669

(22) Filed: May 22, 2007

(65) Prior Publication Data

US 2008/0289160 A1 Nov. 27, 2008

(51) Int. Cl.
*A44B 11/12* (2006.01)

(52) U.S. Cl. ..... 24/170; 24/191; 24/193; 2/426; 2/428; 2/448

(58) Field of Classification Search ..... 24/170, 24/265 BC, 68 SK, 71 SR, 629, 636, 637, 24/68 E, 191, 193; 2/426, 428, 448; 351/43
See application file for complete search history.

(56) References Cited

U.S. PATENT DOCUMENTS

| | | | | |
|---|---|---|---|---|
| 6,349,420 | B1 * | 2/2002 | Chiang | 2/428 |
| 6,832,394 | B1 * | 12/2004 | Chiang | 2/428 |
| 6,961,965 | B2 * | 11/2005 | Chiang | 2/445 |
| 7,020,905 | B2 * | 4/2006 | Chiang | 2/448 |
| 7,055,182 | B2 * | 6/2006 | Chiang | 2/450 |
| 7,134,149 | B2 * | 11/2006 | Sato | 2/431 |
| 7,146,653 | B2 * | 12/2006 | Chou | 2/426 |
| 7,257,848 | B2 * | 8/2007 | Chiang | 2/448 |
| 7,389,548 | B2 * | 6/2008 | Chiang | 2/450 |
| 7,631,400 | B2 * | 12/2009 | Chiang | 24/170 |
| 7,640,633 | B2 * | 1/2010 | Chou | 24/68 E |
| 2006/0010585 | A1 * | 1/2006 | Chiang | 2/426 |
| 2006/0015990 | A1 * | 1/2006 | Chiang | 2/426 |
| 2006/0059607 | A1 * | 3/2006 | Chiang | 2/428 |

* cited by examiner

*Primary Examiner* — Robert J Sandy
*Assistant Examiner* — Rowland D Do
(74) *Attorney, Agent, or Firm* — Rabin & Berdo, P.C.

(57) ABSTRACT

A buckle set, two of which pair off for being inset in frame of the swimming goggles on two sides so that a strap can be inserted in the buckle sets for fastening the swimming goggles on user's face. Structure of the present invention features a $2^{nd}$ bump, which keeps the buckle in effective spacing even when the buckle is loaded with force and thus keeping the buckle well covered by the buckle hood.

10 Claims, 6 Drawing Sheets

STRUCTURE OF BUCKLE SET

BACKGROUND OF THE INVENTION

I. Field of the Invention

The present invention relates to a buckle set, two of which pair off for being inset in frame of a pair of swimming goggles on two sides so that the swimming goggles can be fastened on user's face by a strap which is inserted into the buckle set; specifically, to a buckle set that allows the strap to easily and quickly be adjusted to a desired length.

II. Description of the Prior Art

With reference to FIG. 1, which is a sectional view of the prior art, a pair of swimming goggles 10 mainly consists of a pair of lenses 101, a strap 102 and a pair of buckle sets 103. Said pair of buckle sets are inset in frame of the swimming goggles 30 on two sides. The buckle set 103 mainly comprises a buckle seat 1031, a buckle 1032 and a buckle hood 1033. The buckle 1032 comprises a bump 10322, which is formed on one end. When the strap 102 is inserted into buckle set 103, the bump 10322 butts in one of the teeth 1021 on the strap end so as to set the strap 102 at a desired length. The teeth 1021 are formed on the surface of two ends of the strap 102. The buckle 1032, which comprises pivot 10321, is pivoted on the buckle seat 1031. When the strap 102 is inserted into the buckle seat 1031, in which the buckle 1032 has been ensconced, pull the strap with force so that the bump 10322 of the buckle 1032 butts in one of the teeth 102 for setting the strap at a desired length. Under the circumstances, there is hardly any chance for the strap 102 to come off from the buckle set 103. With reference to FIG. 2, which is a sectional view of assembly of the prior art, the buckle set 103 is buckled up. When the buckle set 103 is buckled up, the buckle 1032 is positioned against teeth 1021 formed on the strap. However, when the strap 102 is pulled by a force in the direction indicated by the arrow in FIG. 2, the bump 10322 of the buckle 1032 would also be lifted up, and thus pushing the buckle hood 1033 apart. Consequently, the swimming goggles would be loosened and come off from user's face.

SUMMARY OF THE INVENTION

Main objective of the present invention is to provide a structure that can always keep the buckle in effective spacing and the strap at a desired length. Moreover, though the structure is constructed with separate parts, it would not come apart even being loaded with force.

The buckle set of the present invention, which mainly consists of a buckle seat, a buckle and a buckle hood, is inset in frame of a pair of swimming goggles on two sides so that a strap can be inserted in the buckle set for fastening the swimming goggles on user's face. The buckle seat is designed with a barrier and the buckle with a $2^{nd}$ bump. When the buckle is ensconced in the buckle seat, interaction of the $2^{nd}$ bump and the barrier can keep the buckle in effective spacing, and thus keeping the buckle tightly covered by the buckle hood.

Desirable structure, assembly and features of the present invention will be better understood from the detailed description and drawings that follow, in which various embodiments of the disclosed invention are illustrated by way of example.

DESCRIPTION OF THE PREFERRED EMBODIMENTS

Figure 1:
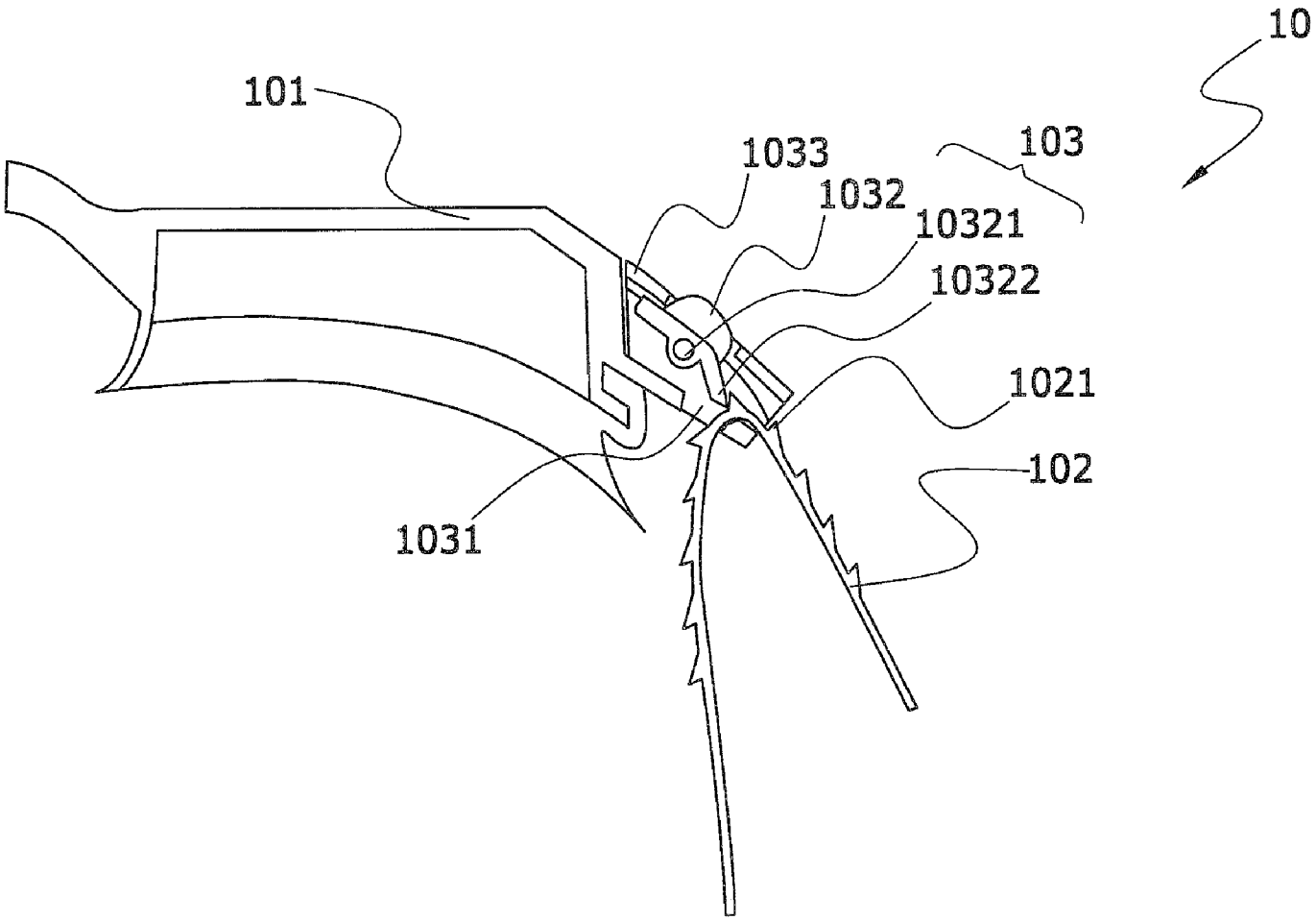
Fig. 1 (Prior Art)
FIG. 1 is a sectional view of the prior art.
Figure 2:
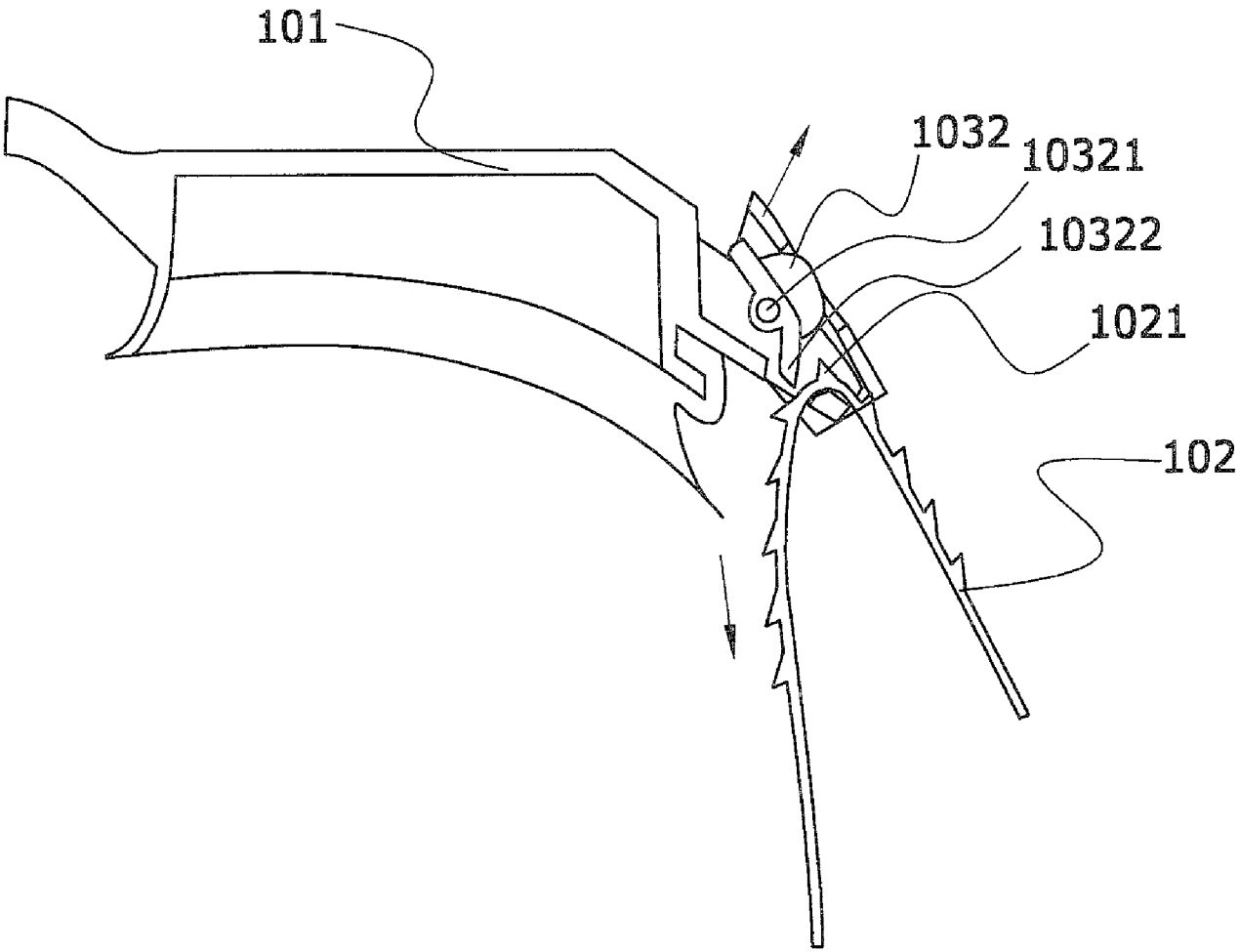
Fig. 2 (Prior Art)
FIG. 2 is a sectional view of assembly of the prior art.
Figure 3:
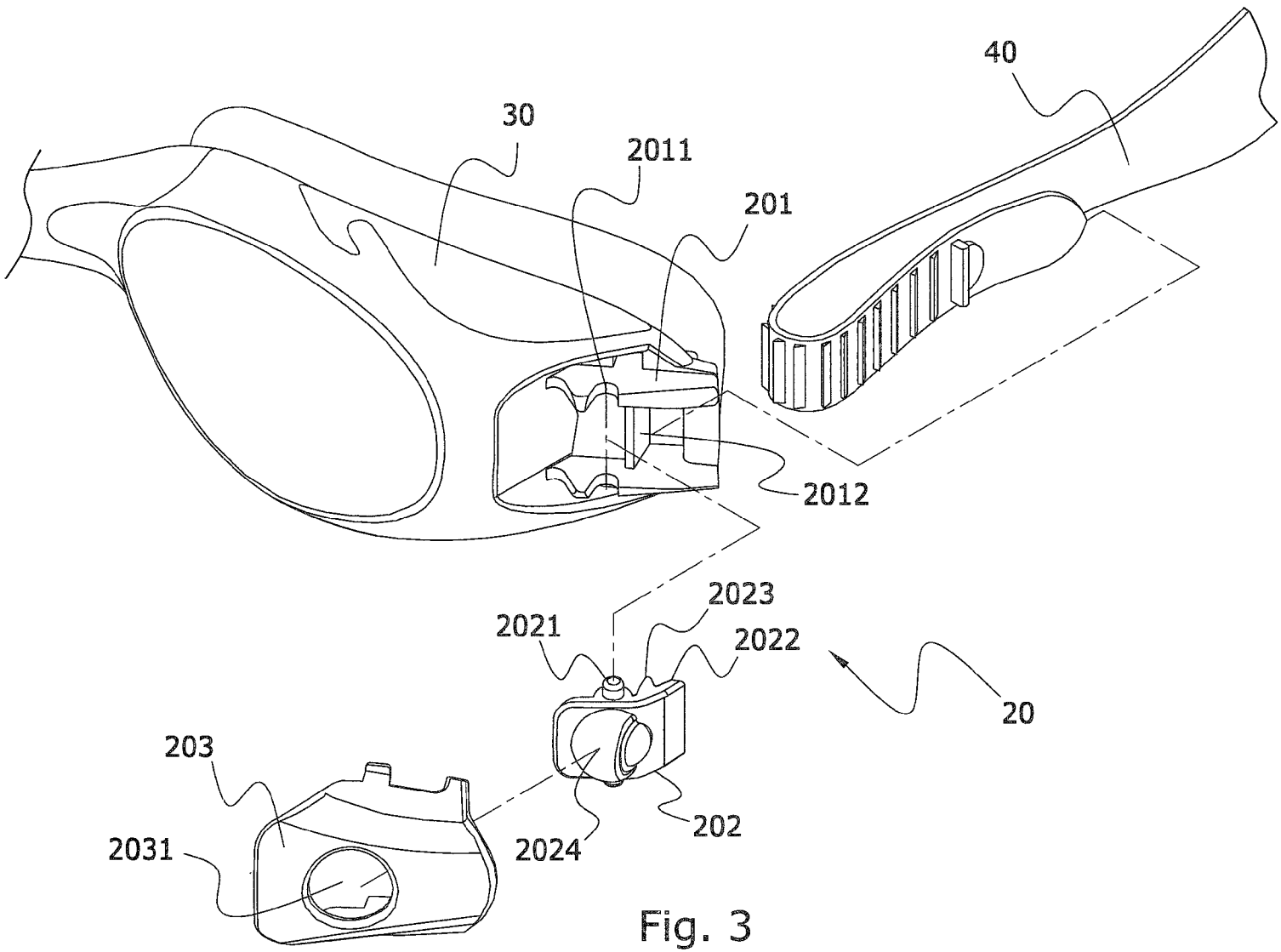
FIG. 3 is a three-dimensional view of the invention.

With reference to FIG. 3, which is a three-dimensional view of the present invention, the present invention consists of a pair of buckle sets 20, each of which comprises a buckle seats 201, a buckle 202 and a buckle hood 203. The buckle seat 201 mainly comprises a pivot slot 2011 and a barrier 2012. The buckle 202 comprises two pivots 2021, two bumps—a 1st bump 2022 and a 2nd bump 2023, and a press stud 2024. The buckle hood 203 is a removable cover over the buckle seat 201 that comprises a hole 2031, which is in a position corresponding to press stud 2024 on the buckle 202. Insert a buckle set 20 into frame of the swimming goggles (i.e., eyewear) on one side per following steps: infix the buckle seat 201 into frame of the swimming goggles on one side; ensconce the buckle 202 into buckle seat 201; fit the buckle hood 203 onto buckle seat 201 so as to cover the buckle 202, and thus the press stud 2024 partially protruding from the hole 2031. Repeat the foregoing steps to inset another buckle set in frame of the swimming goggles on the other side. After the buckle sets are inset into frame of the swimming goggles, insert two ends of the strap 40 into buckle sets respectively. Accordingly, the strap 40 can easily be adjusted to a desired length from its two ends by pressing the press studs 2024 on two sides of the swimming goggles 30. It is clear that the present invention provides user's friendliness and easiness in adjusting the strap length.

Figure 4:
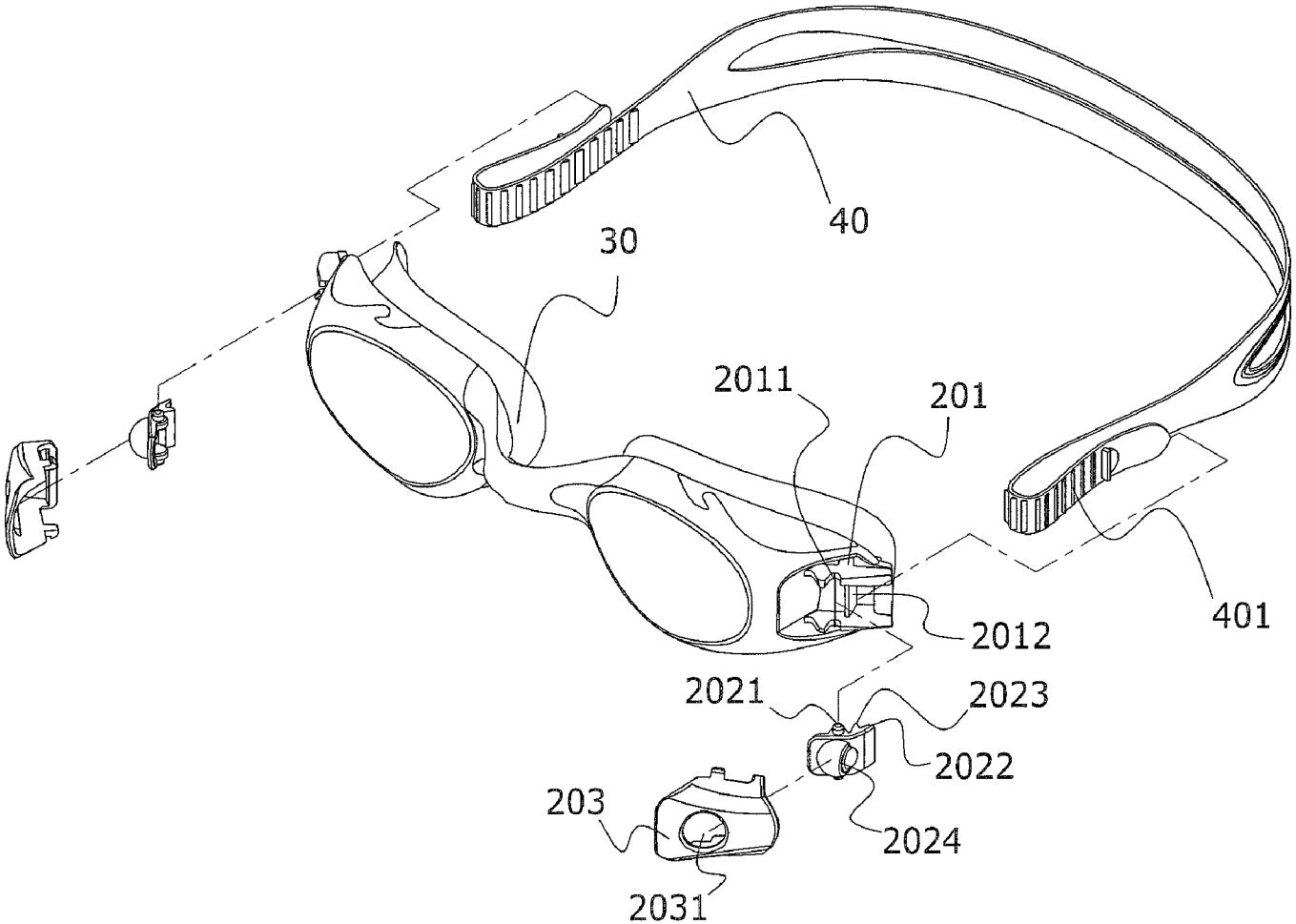
FIG. 4 shows assembly of the invention.

With reference to FIG. 4, which shows assembly of the present invention, the present invention is inset in frame of the swimming goggles 30 and assembled per following steps: infix a buckle seat into frame of the swimming goggles on one side; insert one end of a strap 40 into said buckle seat 201; ensconce a buckle 202 in said buckle seat 201, and fit a buckle hood 203 onto said buckle seat. Repeat the foregoing steps to inset another buckle set in frame of the swimming goggles 30 on the other side. The strap is well fastened from its two ends at a desired length because the $1^{st}$ bump 2022 of the buckle 202 butts in one of the teeth 401 on the strap 40 and the $2^{nd}$ bump 2023 of the buckle 202 jostles against the barrier 2012 of the buckle seat 201. The teeth 401 are formed on the surface of two ends of the strap 40. Moreover, the buckle seat 201 may be a separate part or an integrated part formed on frame of a pair of swimming goggles 30.

Figure 5:
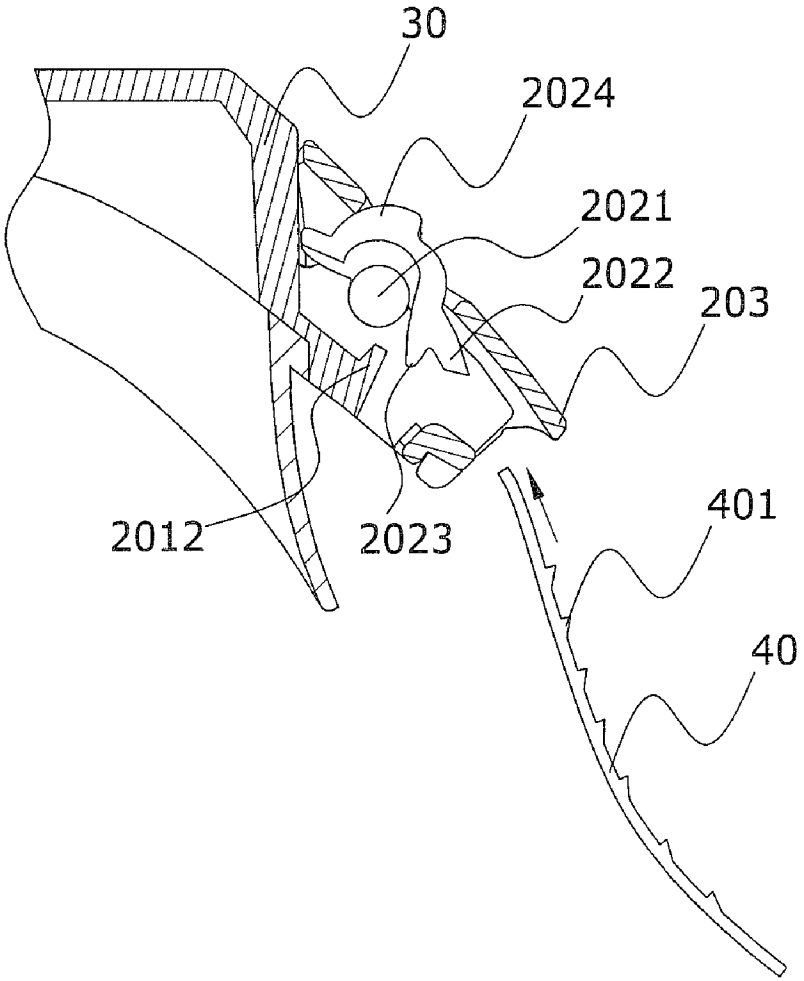
FIG. 5 is a sectional view of embodiment (I) of the invention.

With reference to FIG. 5, which is a sectional view of embodiment (I) of the present invention, the buckle 202 is unbuckled so that the strap can be adjusted to a desired length. When the buckle 202 is unbuckled, the strap 40 can run freely as the $1^{st}$ bump 2022 lifts up and is spaced apart from teeth 401 of the strap 40. Under the circumstances, the user can easily and quickly adjust the strap from its two ends to a desired length, and press the press studs 2024 to set the strap at the desired length.

Figure 6:
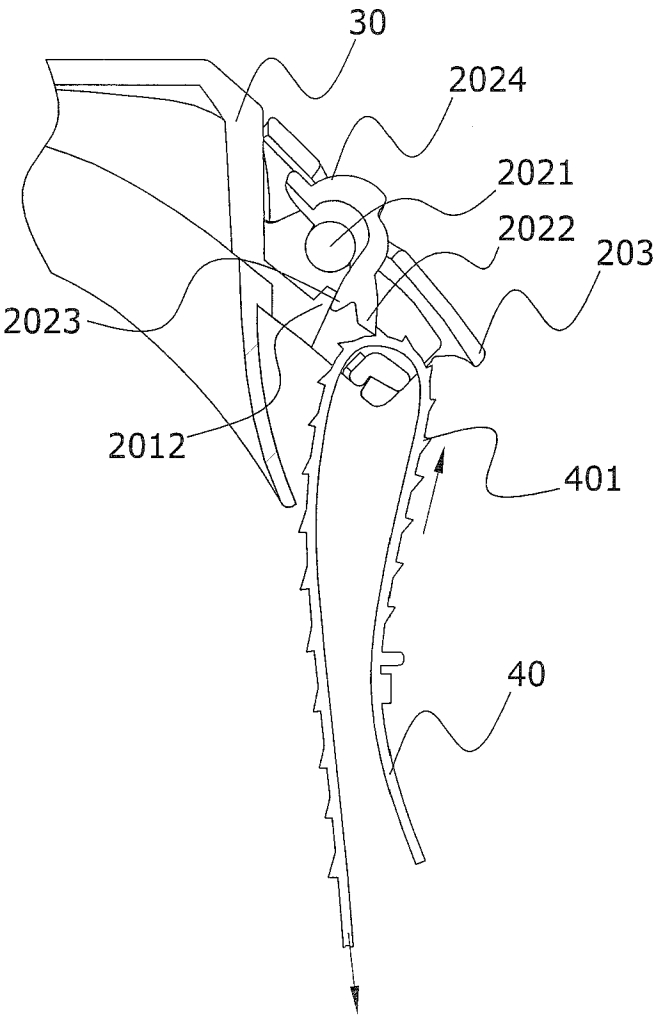
FIG. 6 shows embodiment (II) of the invention.

With reference to FIG. 6, which shows embodiment (II) of the present invention, the buckle 202 is buckled up to set the strap 40 at a desired length. When the buckle 202 is buckled up, its $1^{st}$ bump 2022 butts in one of the teeth 401 on the strap 40 and its $2^{nd}$ bump 2023 jostles against barrier 2012 of the buckle seat 201. The buckle 202 thus has effective spacing and can be well housed in the buckle hood 203. Structure of the present invention leaves hardly any chance for the buckle 202 to deflect and the strap coming off even when the strap is pulled by force.

It is clear that the present invention uses the interaction of the $2^{nd}$ bump and the barrier to keep the buckle in effective spacing. When the $2^{nd}$ bump of the buckle jostles against the barrier of the buckle seat, the buckle is kept in effective spacing even when the buckle is loaded with force. The foregoing embodiments prove that parts of the present invention are tightly held together after assembly and would not come apart under any circumstances.

While the present invention is susceptible to various modifications and alternative forms, the specific embodiments have been shown by way of example in the drawings and described in detail herein. However, it should be understood that the present invention is not intended to be limited to the particular form disclosed. Rather, the present invention is to cover all modifications, equivalents, and alternatives falling within the spirit and scope of the present invention as defined by the appended claims.

What is claimed is:

1. A buckle set, disposed on a respective flank of swimming eyewear, and allowing a strap having a plurality of teeth to pass there through, the buckle set comprising:

a buckle, including:

a pivot, formed on two sides of the buckle;

a first bump, formed on one end of the buckle;

a second bump, formed between the pivot and the first bump; and a pressed stud, formed on an opposite side of the buckle from the one end of the buckle;

a buckle seat, including:

a pivot slot in a semi-circular recess shape for holding the pivot; and a barrier, formed adjacent to the pivot slot and positioned against the second bump; and a buckle hood, removably covering the buckle seat, the buckle hood including a hole disposed in a position corresponding to the pressed stud, wherein the first bump butts against one of the teeth and the second bump presses against the barrier at the same time when tension is applied to the strap by a user.

2. The buckle set of claim 1, wherein the buckle seat is integrally formed with the swimming eyewear.

3. The buckle set of claim 1, wherein the first bump is extended outward from the one end of the buckle, and the second bump is extended from a surface of the buckle toward the barrier in a slant direction.

4. The buckle set of claim 1, wherein the buckle includes a third bump formed on another end thereof.

5. A buckle set, disposed on a respective flank of swimming eyewear, and allowing a strap having a plurality of teeth to pass there through, the buckle set comprising:

a buckle, including:

a pivot, formed on two sides of the buckle;

a first bump, formed on one end of the buckle;

a second bump, formed between the pivot and the first bump; and a pressed stud, formed on an opposite side of the buckle from the one end of the buckle;

a buckle seat, including:

a pivot slot in a semi-circular recess shape for holding the pivot; and a barrier, formed adjacent to the pivot slot and positioned against the second bump; and a buckle hood, removably covering the buckle seat, and the buckle hood including a hole disposed in a position corresponding to the pressed stud, wherein the first bump butts against one of the teeth and the second bump presses against the barrier at the same time when tension is applied to the strap by a user, and the first and second bumps are not pressed by the buckle seat when tension is not applied to the strap by the user.

6. The buckle set of claim 5, wherein the buckle seat is integrally formed with the swimming eyewear.

7. The buckle set of claim 5, wherein the first bump is extended outward from the one end of the buckle, and the second bump is extended from a surface of the buckle toward the barrier in a slant direction.

8. The buckle set of claim 5, wherein the buckle includes a third bump formed on another end thereof.

9. A buckle set, disposed on a respective flank of swimming eyewear, and allowing a strap having a plurality of teeth to pass there through, the buckle set comprising:

a buckle, including:

a pivot, formed on two sides of the buckle;

a first bump, formed on one end of the buckle;

a second bump, formed between the pivot and the first bump; and a pressed stud, formed on a surface of the buckle, wherein when the stud is pressed, the stud and the first bump are freely rotated together on opposite sides of the buckle about the pivot;

a buckle seat, including:

a pivot slot in a semi-circular recess shape for holding the pivot; and a barrier, formed adjacent to the pivot slot and positioned against the second bump; and a buckle hood, removably covering the buckle seat, the buckle hood including a hole disposed in a position corresponding to the pressed stud, wherein the first bump butts against one of the teeth and the second bump presses against the barrier at the same time when tension is applied to the strap by a user.

10. The buckle set of claim 1, wherein the buckle includes a third bump formed on another end thereof, and the third bump, when bumping against the swimming eyewear or the buckle hood, stops the stud and the first bump from being freely rotated about the pivot.

* * * * *